US005860543A

United States Patent [19]

Decelles

[11] Patent Number: 5,860,543

[45] Date of Patent: Jan. 19, 1999

[54] CLOSURE CAP

[75] Inventor: Gilles Decelles, Waterloo, Canada

[73] Assignee: Bouchons Mac Inc., Waterloo, Canada

[21] Appl. No.: 794,095

[22] Filed: Feb. 3, 1997

[30] Foreign Application Priority Data

Nov. 12, 1996 [CA] Canada ..... 2190172

[51] Int. Cl.[6] ..... B65D 47/08; B65D 50/08

[52] U.S. Cl. ..... 215/209; 215/216; 215/225; 215/237; 220/259; 220/281; 220/339; 222/556; 222/153.14

[58] Field of Search ..... 215/224, 225, 215/216, 209, 205, 206, 204, 235, 237, 245, 274, 306, 303, 321, 317; 220/239, 375, 281, 259; 222/556, 153.14

[56] References Cited

U.S. PATENT DOCUMENTS

| | | | |
|---|---|---|---|
| 2,852,054 | 9/1958 | Motley . | |
| 3,462,048 | 8/1969 | Henchert . | |
| 3,612,322 | 10/1971 | Linkletter . | |
| 3,826,394 | 7/1974 | Stull . | |
| 3,845,872 | 11/1974 | Towns et al. . | |
| 3,934,745 | 1/1976 | Lovell . | |
| 3,941,268 | 3/1976 | Owens et al. . | |
| 4,042,105 | 8/1977 | Taylor . | |
| 4,170,315 | 10/1979 | Dubach et al. | 220/281 |
| 4,284,200 | 8/1981 | Bush et al. . | |
| 4,334,639 | 6/1982 | Gach | 222/556 X |
| 4,535,905 | 8/1985 | Sandhaus . | |
| 4,759,455 | 7/1988 | Wilson | 215/211 X |
| 4,807,768 | 2/1989 | Gach | 215/237 X |
| 4,838,441 | 6/1989 | Chernack | 215/216 |
| 4,892,208 | 1/1990 | Sledge | 215/216 |
| 5,069,367 | 12/1991 | Salmon et al. | 222/556 X |
| 5,092,493 | 3/1992 | Pehr . | |
| 5,335,802 | 8/1994 | Brach et al. . | |
| 5,354,539 | 10/1994 | Hovatter . | |
| 5,472,542 | 12/1995 | Wermund . | |
| 5,497,906 | 3/1996 | Dubach . | |
| 5,573,127 | 11/1996 | Takahashi et al. . | |
| 5,575,399 | 11/1996 | Intini | 220/339 X |
| 5,579,957 | 12/1996 | Gentile et al. | 215/237 X |

FOREIGN PATENT DOCUMENTS

| | | | |
|---|---|---|---|
| 0603090 | of 1993 | European Pat. Off. . | |
| 634338 | 1/1995 | European Pat. Off. | 222/556 |
| 2628716 | 9/1989 | France | 215/216 |
| 3625477 | of 1988 | Germany . | |

*Primary Examiner*—Stephen K. Cronin
*Assistant Examiner*—Nathan Newhouse
*Attorney, Agent, or Firm*—ROBIC

[57] ABSTRACT

The closure cap for sealing a container has an inner skirt shaped and sized to fit externally and to be secured onto the neck of the container. The cap also has an outer skirt projecting from the inner skirt. This outer skirt extends over the inner skirt at a given distance from same, thereby defining a gap there between. The outer skirt is made of a material that is resiliently flexible and can be deformed when an external pressure is applied onto its external surface. The cap further has a foldable cover shaped and sized to close the neck of the container. This cover has a peripheral edge attached to the outer skirt by a hinge. A snap having one part integral to the upper portion of the other skirt and another part integral to the cover is provided for releasably locking the cover in a closed position when it is folded down over the neck of the container. The one part of the snap that is integral to the upper portion of the outer skirt is positioned and devised to move and disengage the other part of the snap means and thus release the cover, when external pressure is applied at a suitable location onto the external surface of the outer skirt.

15 Claims, 8 Drawing Sheets

CLOSURE CAP

FIELD OF THE INVENTION

The invention relates to a closure cap for sealing a container. More particularly the invention relates to a closure cap which is very easy to open by an adult.

BACKGROUND OF THE INVENTION

Closure caps are known, which are child resistant and comprise a skirt that must be manually squeezed in a given radial direction to permit unscrewing of it and removal from the container. An example of such a closure which can only be used on a container whose neck has especially been adapted for this purpose, is described in U.S. Pat. No. 3,941,268. It is worth noting that such closure caps can only be opened with two hands (one holding the container, the other one squeezing and turning the cap).

Also known are closure caps which comprise a foldable top cover that can be snapped down in a closed position. To release the cover and open the container, one has to apply pressure on top of it to deform its edges and cause it to unsnap. Closures of this type are described, by way of examples, in U.S. Pat. Nos. 3,612,322 (see FIGS. 18 to 20 of it), 3,934,745 (see FIGS. 3 and 4 of it), 3,845,872 and 4,535,905.

In spite of those existing closure caps, there is still a need for a closure cap which is efficient and easy to use with any kind of container, with no special adaptation thereof. The expression "efficient and easy to use" as used herein means that the cap must be easy to open for adults and elderly persons.

There is also a need for a closure cap which is not removable from the container when same is open (as is the cap of U.S. Pat. No. 3,941,268), and which, therefore, does not risk getting lost once the container is open.

There is further a need for a child resistant closure cap which is very reliable and easy to open with one hand only.

There is further a need for a cap which is easy to open in the dark or by people who have vision problems.

SUMMARY OF THE INVENTION

The object of the present invention is to provide a closure cap which satisfies the above mentioned needs.

More particularly, the invention provides a closure cap for sealing a container having an opening surrounded by a neck. This cap comprises an inner skirt shaped and sized to fit externally onto the neck. This inner skirt has an upper portion and a lower portion.

Attachment means are provided, which are integral to the inner skirt and devised in such a way as to cooperate with corresponding attachment means provided onto the neck for securing the inner skirt onto it, preferably in a non-removable manner.

The cap also comprises an outer skirt projecting from the inner skirt. This outer skirt which is preferably, but not necessarily connected to the upper portion of the inner neck, has an upper portion, a lower portion and an external surface. It is made of a material that is resiliently flexible and can be deformed when an external pressure is applied onto its external surface. It extends over the inner skirt at a given distance from the same, thereby defining a gap there between.

The cap further comprises a cover shaped and sized to close the opening of the container. This cover has a peripheral edge attached to the outer skirt by a hinge and being foldable up and down about the hinge.

Snap means are provided for releasable locking the cover in a closed position when it is folded down over the neck of the container. These snap means have one part integral to the upper portion of the outer skirt and another part integral to the cover. The one part of the snap means that is integral to the upper portion of the outer skirt is positioned and devised to move and disengage the other part of the snap means, thus releasing the cover, when external pressure is applied at a suitable location onto the external surface of the lower portion of the outer skirt.

In use, the closure cap is attached to the neck of the container and the cover maintained by the snap means in a closed position to close the container opening. To release the cover, one has only to exert sufficient pressure onto a suitable location of the outer surface of the outer skirt.

A non-restrictive description of a plurality of preferred embodiments will now be given with reference to the appended drawings.

DESCRIPTION OF SEVERAL PREFERRED EMBODIMENTS

The cap 10 according to the first embodiment of the invention as shown in FIGS. 1 to 6 is intended to be used for closing the opening of the container 60.

Figure 2:
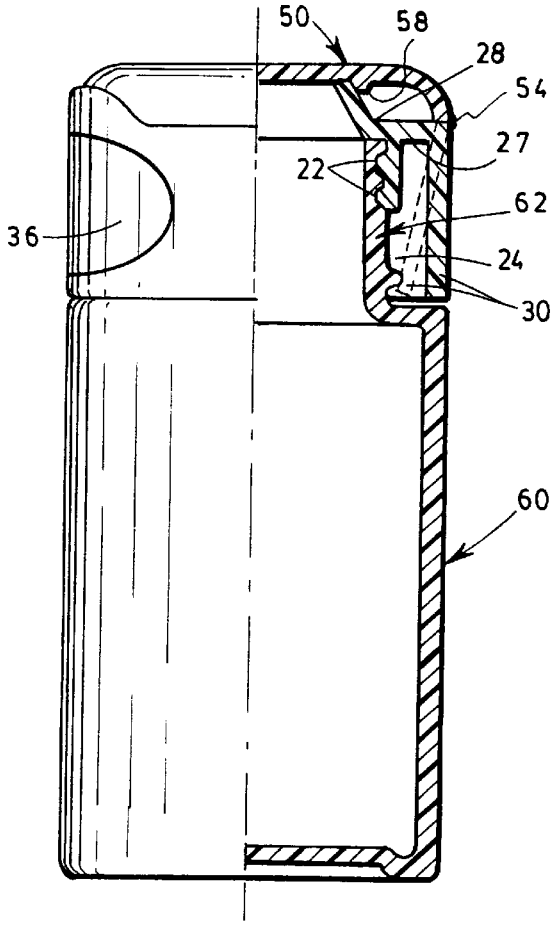
FIG. 2 is a side elevational, partial cross-sectional view of the cap of FIG. 1, showing the same installed onto the neck of a container.
Figure 3:
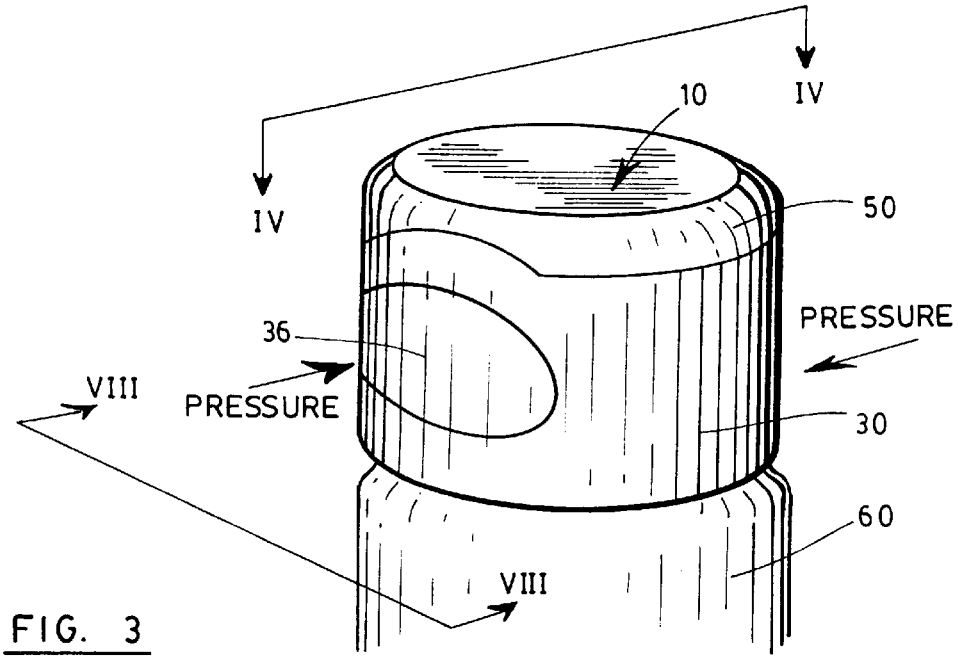
FIG. 3 is a view similar to FIG. 1, showing the cap in a closed position.

The container 60 which is shown on FIGS. 2 and 3 is of a conventional shape and comprises an opening surrounded by a neck portion 62.

The cap 10 comprises an inner skirt 20 and an outer skirt 30. The inner skirt 20 has an upper portion and a lower portion and is shaped and sized to fit externally onto the neck 62. To secure the cap 10 to the container 60 in a removable or a non-removable manner, the inner skirt 20 is provided with attachment means which are integral to the inner skirt 20. These attachment means cooperate with corresponding attachment means provided onto the neck 62. As shown in FIG. 2, non-removable attachment means may consist of one or more peripheral beads 22 or of a succession of small bumps, provided on the internal face of the inner skirt 20 and on the external face of the neck portion 62 in such a manner as to snap within each other. However, any other kind of attachment means known per se in this art could alternatively be used. Removable attachment means may consist of a screwing device.

As shown in FIGS. 1 to 6, the outer skirt 30 is preferably tubular in shape. However, the outer skirt 30 could be of another shape. Thus, for example, the outer skirt 30 could comprise two flat surfaces on which pressure would be applied.

This outer skirt 30 is connected to and projects from the upper portions of the inner skirt 20. The outer skirt 30 extends over the inner skirt 20 at a given distance from the same, thereby defining a gap 24 between the same and the neck portion 62 of the container 60.

Figure 1:
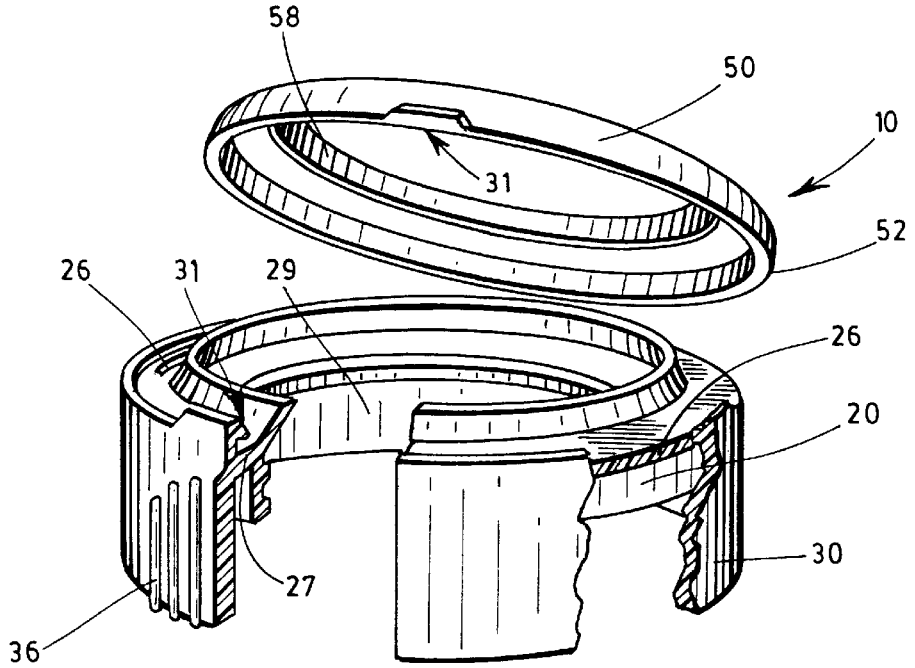
FIG. 1 is a partial perspective view of a closure cap according to a first embodiment of the invention.

As is better shown on FIG. 1 the outer skirt 30 is advantageously connected to the upper portion of the inner skirt 20 by a peripheral transversal wall 27. This wall 27 propagates the force induced by a pressure which may be applied on the outer skirt 30. Some portions 26 of the wall 27 may advantageously be slotted. Such slotted portions 26 being located respectively at substantially the same distance from both the hinge 54 and the snap means 31 as will be better described hereinafter.

The cap 10 also comprises a cover 50 shaped and sized to close the opening of the container 60. The cover 50 has a peripheral edge 52 that is attached to the outer skirt 30 by a hinge 54 (shown in FIG. 4). The cover 50 is foldable up and down about this hinge 54.

Figure 4:
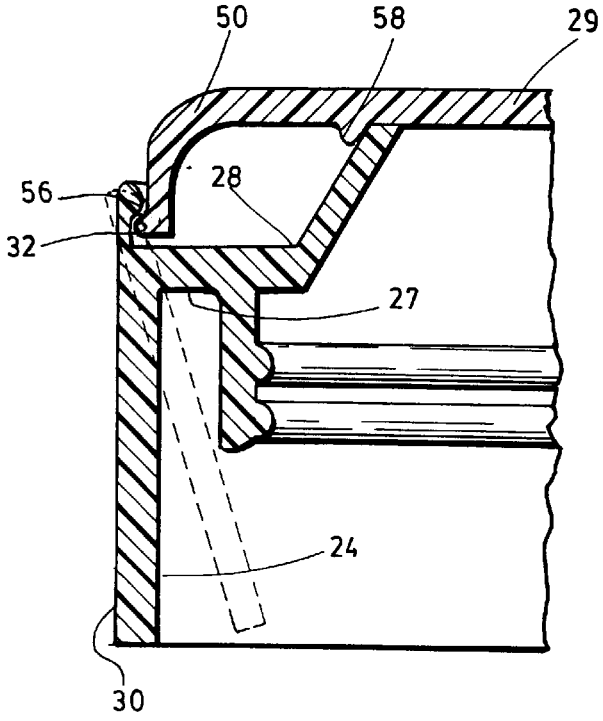
FIG. 4 is a fragmentary, cross-sectional view taken along line IV—IV of FIG. 3.

As illustrated in FIGS. 1, 2 and 4, the inner skirt 20 is provided with a partition element 28 which projects inwardly and partly obturates the container opening. The partition element 28 may extend the peripheral transversal wall 27 and comprises an orifice 29 which is advantageously sized and shaped according to the texture of the product (i.e. solid, liquid, colloidal, etc..) with which the container 60 is filled up, in order to permit good outflow of this product when one uses the container 60. In such a case, it is preferred that the cover 50 has its inner surface provided with a sealing bead 58 shaped and sized to seal the periphery of the orifice 29 of the opening of the partition element 28 when the cover is in a closed position. To seal the opening 58, the cover 50 and/or the partition element 28 may also be provided with any sealing devices. This is well known in the art and need not be further described.

When the cover 50 is folded down over the neck portion 62 of the container 60, it is releasably locked in a closed position (shown in FIGS. 2, 3 or 4) by snap means 31 of a conventional structure. In this embodiment shown in FIGS. 1 to 6, the snap means 31 and the hinge 54 are located in radially opposite positions. As it is better shown in FIG. 4, the snap means 31 has one part 32 integral to the upper portion of the outer skirt 30 and another part 56 integral to the cover 50, respectively.

The outer skirt 30 is made of a material, preferably a plastic material, that is resiliently flexible and can be deformed when an external pressure is applied onto its external surface.

The part 32 of the snap means 31 that is integral to the upper portion of the outer skirt 30 is positioned and devised to move and disengage the other part 56 of the snap means 31, thus releasing the cover 50, when external pressure is applied at a suitable location onto the external surface of the lower portion of the outer skirt 30. Marking means may be provided onto the external surface of the outer skirt 30 underneath the snap means 31 in order to mark the position of the suitable location where the external pressure must be applied to release the cover 50. These marking means may consist of grooves and/or depressions 36 made into the outer surface of the outer skirt 30. They may also consist of a change in the texture of the outer surface of the outer skirt 30 which would be noticeable when one would touch the latter, even in the dark. Alternatively they may consist of a depression or a simple coloured spot.

As better shown in FIG. 1, a part of the outer skirt 30 can project upwardly and thus overlay at least partially the peripheral edge 52 of the cover 50 so that the joint between the cover 50 and the outer skirt 30 is not accessible. Such a design is desirable as it may prevent grasping of the cover 50 by a child to force the container to open. The line defining the joint between the cover 50 and the outer skirt may be of any design.

In use, the closure cap 10 is snapped or otherwise secured onto the neck of the container 60 and the cover 50 is maintained by the snap means 31 in a close position. To release the cover 50, one has only to exert sufficient pressure onto the suitable location that is marked on the outer surface of the outer skirt 30 and below the hinge. As illustrated in FIG. 3 this suitable location underneath the snap means 32. Deformation of the inner skirt 30 as a result of the pressure exerted by the user is made possible thanks to the gap 24 between the outer skirt 30 and the inner skirt 20 and/or the external surface of the neck portion 62 of the container 60. To close the cover 50, one needs only to fold it down over the neck 62 of the container 60 and engage the two part 32 and 56 of the snap means by applying sufficient pressure on top of the cover 50. The slotted portions 26 in the transversal wall 27, if any, facilitate the deformation of the outer skirt 30.

If desired, a short description or logo explaining how to use the cap can be printed or stamped on it at a suitable location.

Figure 5:
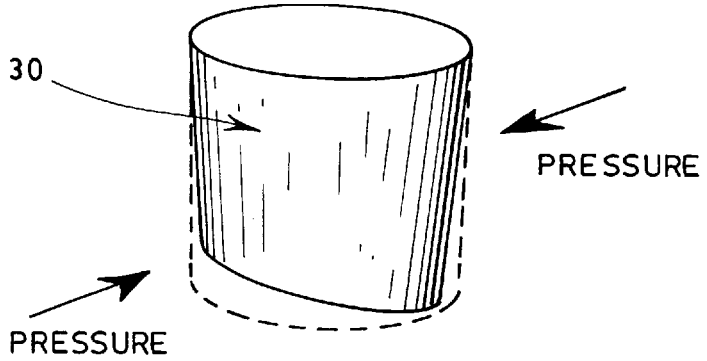
FIG. 5 is a schematic view of the cap of FIG. 1, emphasizing the radial deformation of the outer skirt when pressure is exerted thereon.
Figure 6:
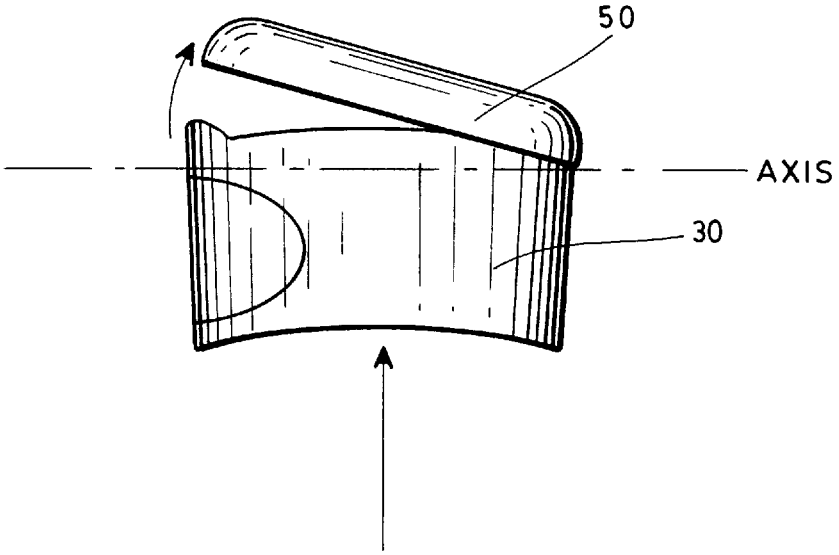
FIG. 6 is a schematic view of the cap of FIG. 1, emphasizing the vertical deformation of the outer skirt when pressure is exerted thereon.

FIGS. 5 and 6 emphasize in a schematic manner the radial and vertical deformations of the outer skirt 30 when the same is pressed. Such deformations causes the snap part 32 to swivel outwardly and to disengage from the corresponding snap part 56 of the cover 50. In the meantime, the cover 50 is pushed up to open and pivot about its hinge 54 by the vertical deformation of the cap shown in FIG. 6.

To further facilitate the deformation of the outer skirt 30, the latter could have portions of reduced thickness. Such portions should be provided peripherally and substantially at the same distance from both the hinge 54 and the snap means 31.

It should be noted that such embodiment renders the cap 10 very difficult for young children to open and thus is of improved safety.

Figure 7:
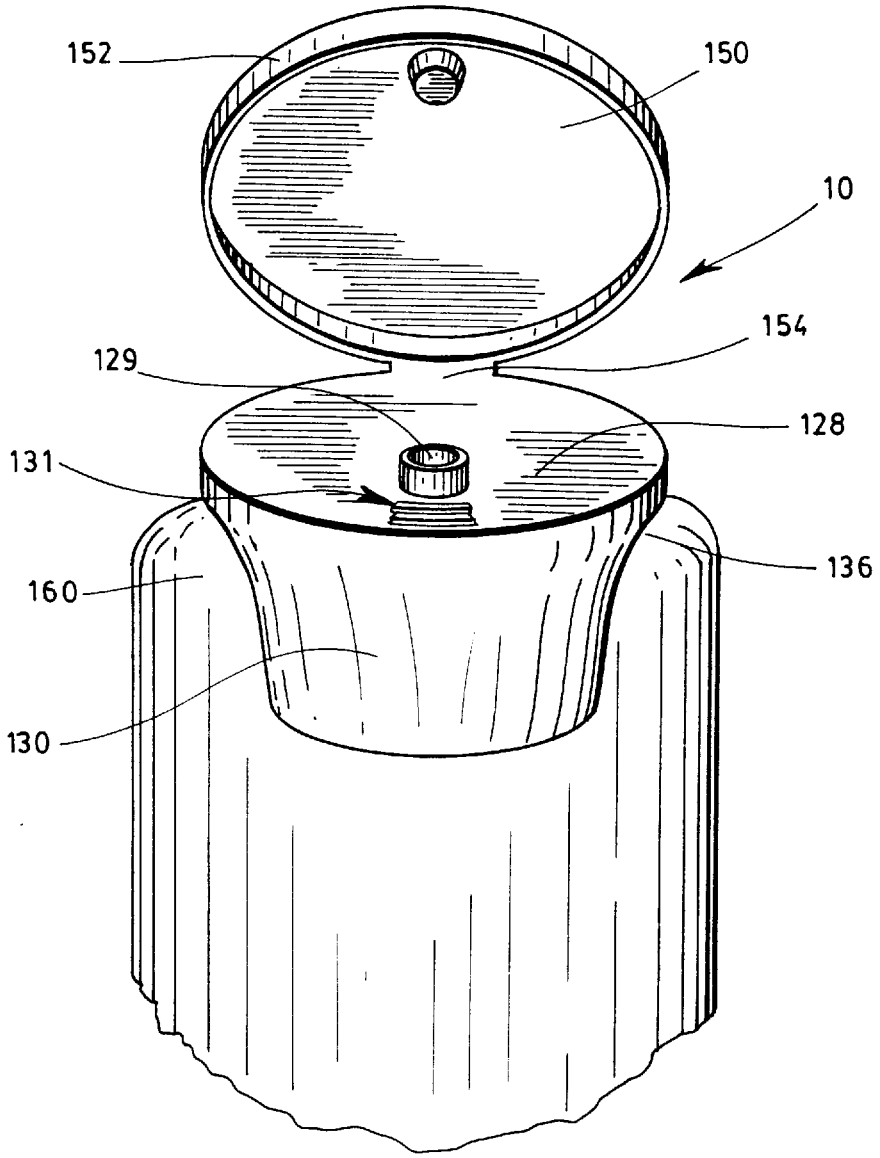
FIG. 7 is a perspective view of a closure cap according to a second embodiment of the invention.
Figure 7A:
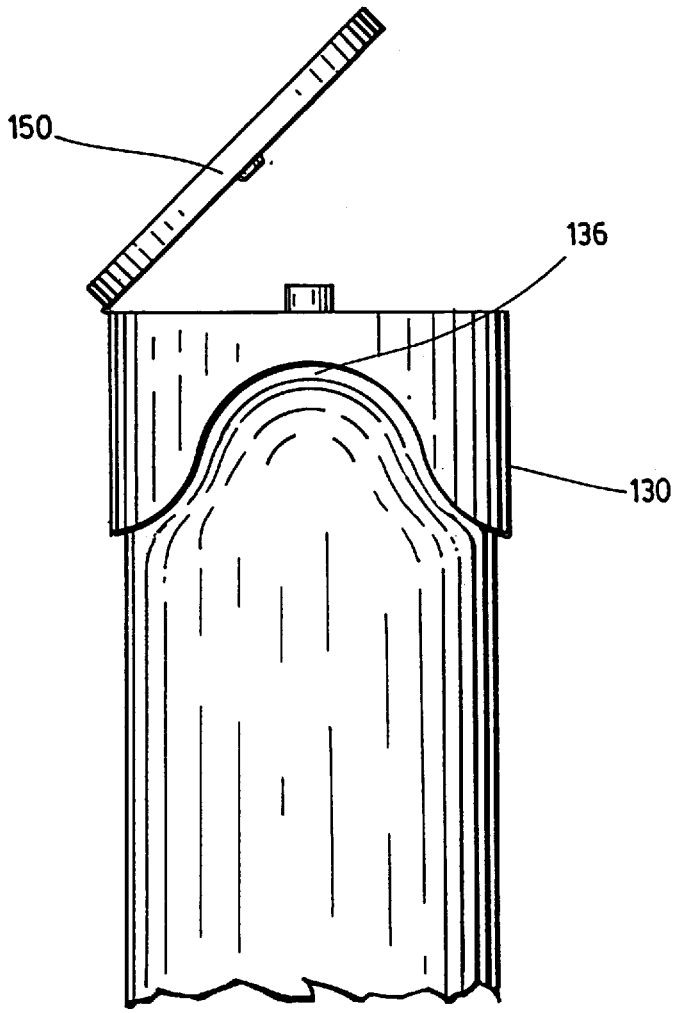
FIG. 7*a* is a side view of the closure cap show in FIG. 7.

The cap 110 according to the second embodiment of the invention as shown in FIG. 7 is similar to the one shown in FIGS. 1 to 6, except that, in order to facilitate deformation of its outer skirt 130, the latter has, instead of portions of a reduced thickness, cut-out portions 136 provided peripherally and substantially at the same distance from both the hinge 154 and the snap means 131.

According to this second embodiment, the peripheral edge 152 of the cover 150 and the upper portion of the outer skirt 130 are also preferably shaped so as to define together a smooth external surface when the cover is locked in a closed position, thereby improving the safety of the cap 110 by preventing grasping of the cover 50 by a child to force the container to open.

In this second embodiment, the cap further comprises a pin 151 provided on the internal surface of the cover 150 to seal the orifice 129. This pin 129 is shaped and sized to fit within the opening 129 provided on the partition element 128 of the cap 110. This is particularly efficient to seal the orifice 129 when this orifice is of a small diameter, like the one illustrated in FIG. 7.

Figure 8:
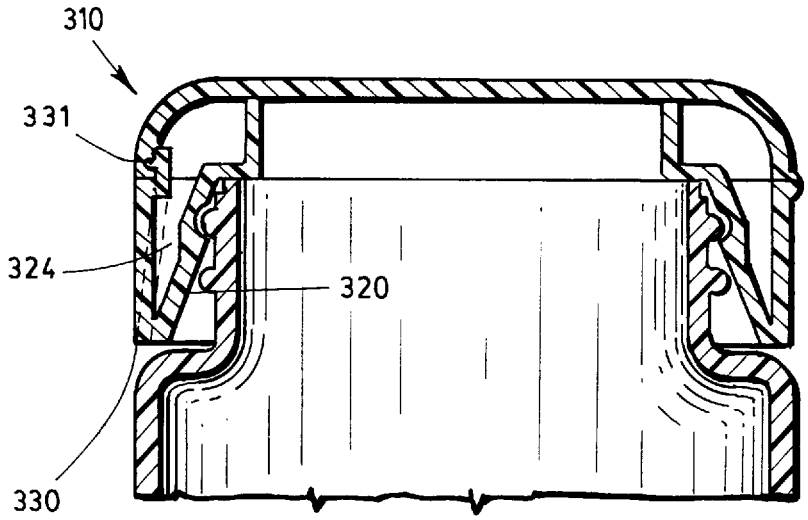
FIG. 8 is a cross-sectional view of a closure cap according to a third embodiment of the invention.

The cap 310 according to the third embodiment of the invention as shown in FIG. 8 is also similar to the caps shown in FIGS. 1 to 7, except that the lower portion of its outer skirt 330 is connected to and projects upwardly from the lower portion of its inner skirt 320. Once again, provided that there is a sufficient gap 324 between the inner skirt 220 and the outer skirt 330, disengagement of the snap means 331 and thus release of the cover 350 is achieved if sufficient pressure (shown in dotted lines) is applied onto the outer skirt 330.

Figure 9:
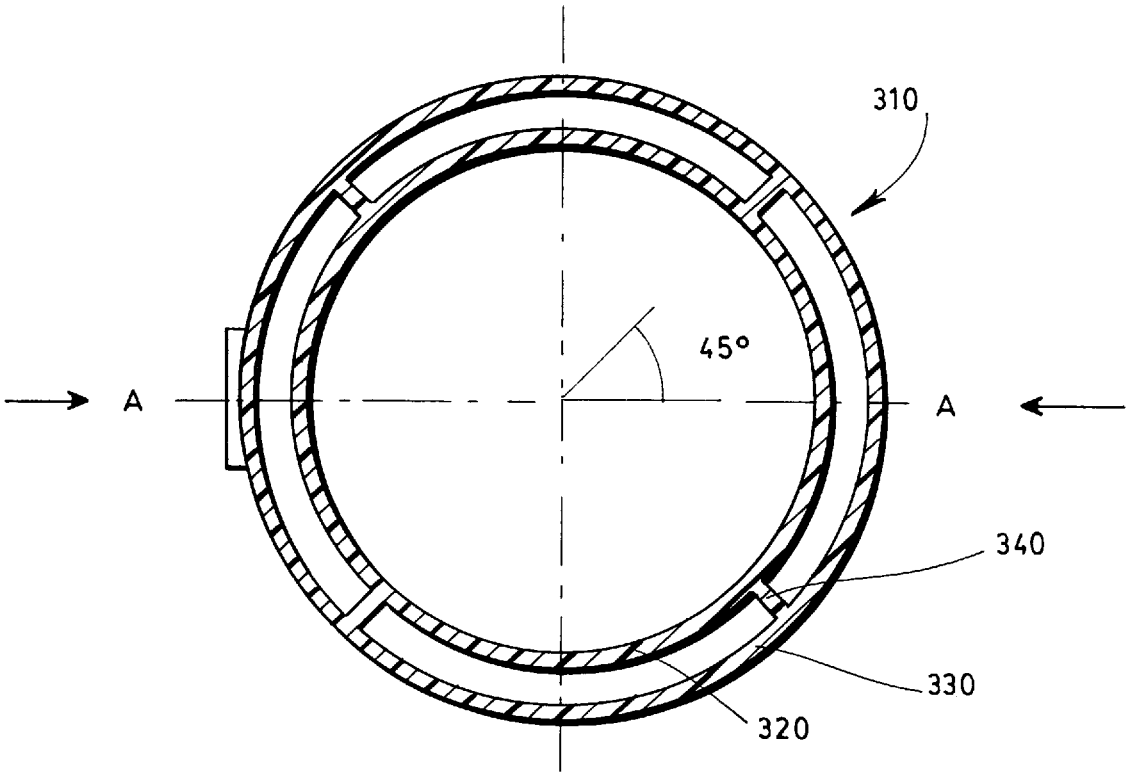
FIG. 9 is a cross-sectional view of a closure cap according to a fourth embodiment of the invention.

The cap 310 according to the fourth embodiment of the invention as shown in FIG. 9 is similar to the caps shown in FIGS. 1 to 8 except that it further comprises radial reinforcement ribs 340 between the inner skirt 320 and the other skirt 330. These ribs 340 are advantageously located along straight lines extending at an optimal angle of about 45° with respect to an axis AA extending between the hinge 354 and the snap means (not shown).

Figure 10:
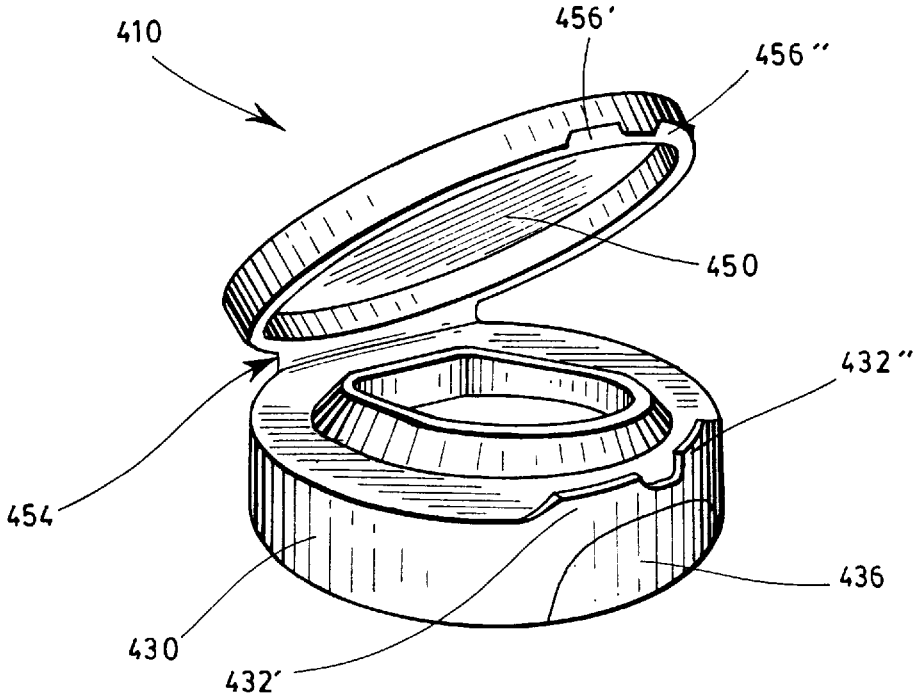
FIG. 10 is a perspective view of a closure cap according to a fifth embodiment of the invention.

The cap 410 according to the fifth embodiment of the invention as shown in FIG. 10 is similar to the caps shown in FIGS. 1 to 9 except that the snap means comprises at least two distinct sets of elements. Each set has one part 432' or 432" integral to the upper portion of the outer skirt 430 and another part 456' or 456" integral to the cover 450. These two distinct sets are peripherally spaced apart from each other. These two distinct sets and the hinge 454 are located in substantially opposite positions. A depression 436 is provided into the external surface of the outer skirt 430 to mark the position of the suitable location where the external pressure must be applied to release the cover 450. As is shown, this depression 436 is positioned between the two distinct sets of elements.

Figure 11:
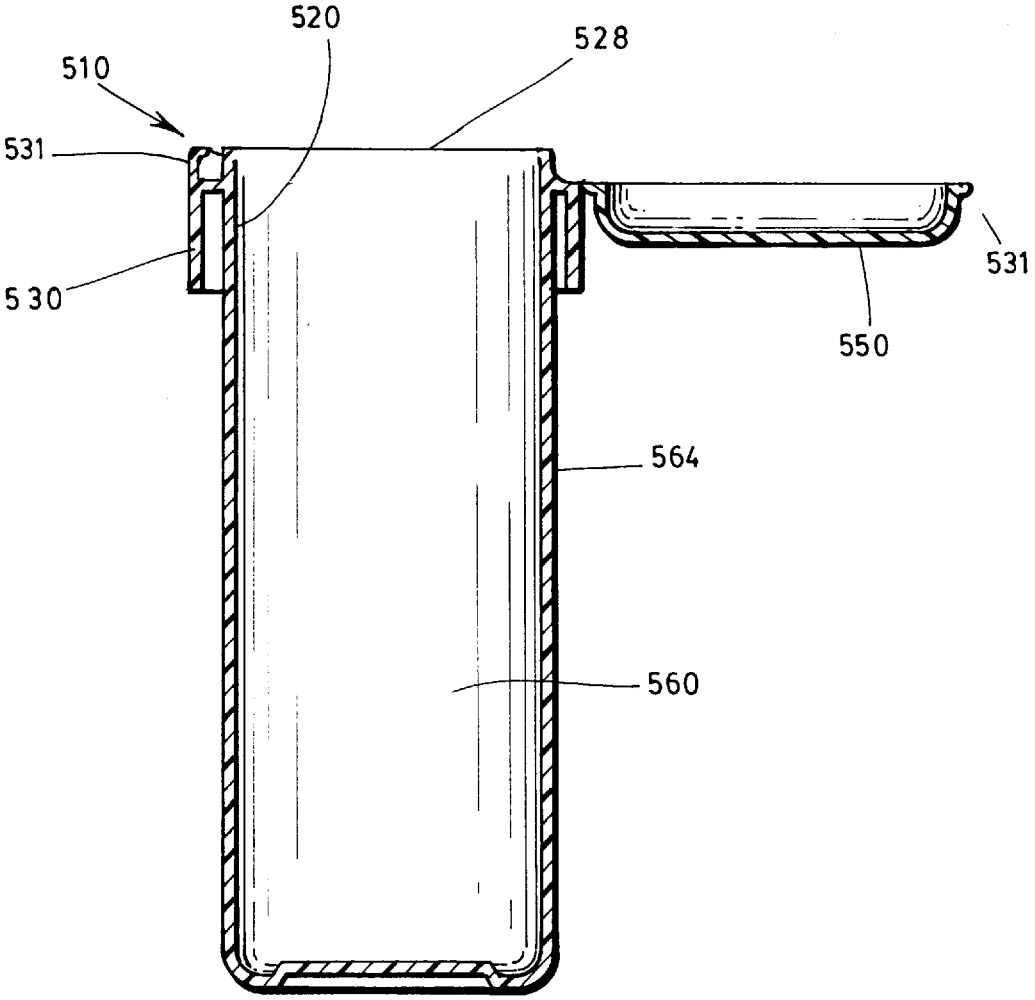
FIG. 11 is a cross-sectional view of a closure cap according to a sixth embodiment of the invention.

The closure cap 510 according to the sixth embodiment of the invention as shown in FIG. 11 is similar to the caps shown in FIGS. 1 to 10 except that it is made integral to the container 560 itself. As shown in FIG. 11, the container 560 is provided with a tubular wall 564, whose upper portion is integral to the inner skirt 520. As the cap 510 is secured to the container 560 by the upper portion of the wall 564, the container 560 requires no more to be provided with any neck portion or attachment means to secure the closure cap 510 on it. This embodiment provides a one-piece container 560 having an efficient and easy-to-open closure system. The cap 510 may be advantageously provided with one or more of the previously described embodiments relating to the inner skirt 520, the outer skirt 530, the cap 550, the partition wall 528, the snaps means 531, etc.

Of course, at least the upper portion of the container 560 defining the inner skirt 520, has to be made of the resilient material which has been described hereinabove for the manufacture of the closure caps shown in FIG. 1 to 10.

All the closure caps described above, may be moulded in one piece with any kind of plastic material. This is well known in the art and need not be further described.

Although preferred embodiments of the invention have been described in detail hereinabove, and illustrated in the accompanying drawings, it is to be understood that the invention is not limited to these embodiments and that various changes and modifications may be made therein without departing from the scope and spirit of the invention.

What is claimed is:

1. A closure cap for sealing a container having an opening surrounded by a neck, said cap comprising:

a) an inner skirt shaped and sized to fit externally onto the neck, said inner skirt having an upper portion and a lower portion;

b) attachment means integral to the inner skirt, said attachment means cooperating with corresponding attachment means provided onto the neck for securing the inner skirt onto said neck;

c) an outer skirt having an upper portion, a lower portion and an external surface, said outer skirt extending over the inner skirt at a given distance from the same, thereby defining a gap therebetween, said outer skirt being of a given thickness and having its upper portion connected to the upper portion of the inner skirt by a peripheral transversal wall;

d) a cover shaped and sized to close the opening of the container, said cover having a peripheral edge attached to the outer skirt by a hinge and being foldable up and down about said hinge above the peripheral wall; and e) snap means having one part integral to the upper portion of the outer skirt and another part integral to the cover, respectively, for releasably locking the cover in a closed position when it is folded down over the neck of the container, wherein said outer skirt and said peripheral wall are made of a material that is resiliently flexible and can be deformed when external pressure is applied onto the external surface of said outer skirt, wherein said snap means is located on the cap in an opposite position with respect to the hinge of the cover; and wherein the one part of the snap means that is integral to the upper portion of the outer skirt extends above the peripheral wall and projects towards the hinge in such a manner as to engage the other part of the snap means when the cover is in the closed position, where by when the external pressure is applied onto the external surface of the outer skirt underneath said snap means, said outer skirt is deformed both laterally and vertically and causes the one part of the snap means to swivel outwardly, to disengage from the other part of the snap means and thus to release the cover while simultaneously pushing said cover up to open and pivot about the hinge.

2. The closure cap of claim 1, wherein the outer skirt is tubular in shape.

3. The closure cap according to claim 2, wherein the snap means comprises at least two distinct sets of elements that are peripherally spaced apart, said two distinct sets of elements and the hinge being located in substantially opposite positions and wherein said cap further comprises means provided onto the external surface of the outer skirt and between said two distinct sets of elements in order to mark the position of the suitable location where the external pressure to release the cover is to be applied.

4. The closure cap according to claim 2, wherein the attachment means integral to the inner skirt consist of a snap.

5. The closure cap according to claim 2, wherein said cap is made of molded plastic.

6. The closure cap according to claim 2, wherein the cover has an inner surface provided with a guiding and sealing ring sized to fit within the opening of the container when the cover is in a closed position.

7. The closure cap according to claim 6, wherein the inner skirt is provided with a partition element which projects inwardly and partly obturates the container opening, said element comprising an orifice, and wherein the cover has an inner surface provided with a sealing bead shaped and sized to seal the orifice of the partition element when the cover is in a closed position.

8. The closure cap according to claim 2, wherein the snap means and the hinge are located in radially opposite positions.

9. The closure cap according to claim 8, wherein the peripheral edge of the cover and the upper portion of the outer skirt are shaped to define together a smooth external surface when the cover is locked in the closed position, thereby preventing holding or grasping of the cover to force the same open.

10. The closure cap according to claim 8, wherein the peripheral edge of the cover in its closed position and the outer skirt define together a joint and wherein the upper portion of the outer skirt extends upwardly to overlay said joint.

11. The closure cap according to claim 8 wherein portions of the peripheral transversal wall are cut, said portions being provided substantially at a same distance from both the hinge and the snap means.

12. The closure cap according to claim 8, wherein the outer skirt has cut-out portions to facilitate the deformation of said outer skirt, said cut-out portions being provided peripherally and substantially at the same distance from both the hinge and the snap means.

13. The closure cap according to claim 8, further comprising means provided onto the external surface of the outer skirt underneath the snap means and the hinge in order to mark two opposite positions where the external pressure should be applied to release the cover.

14. The closure cap according to claim 13, further comprising radial reinforcement ribs between the inner and the outer skirts, said ribs being provided along straight lines extending at an angle of about 45° with respect to an axis extending between the hinge and the snap means.

15. The combination of a closure cap with a container having an opening, said cap comprising:

a) an inner skirt which is made integral to the container in an area surrounding the opening, said inner skirt having an upper portion and a lower portion;

b) an outer skirt having an upper portion, a lower portion and an external surface, said outer skirt extending over the inner skirt at a given distance from the same, thereby defining a gap therebetween, said outer skirt being of a given thickness and having its upper portion connected to the upper portion of the inner skirt by a peripheral transversal wall;

c) a cover shaped and sized to close the opening of the container, said cover having a peripheral edge attached to the outer skirt by a hinge and being foldable up and down about said hinge above the peripheral wall; and d) snap means having one part integral to the upper portion of the outer skirt and another part integral to the cover, respectively, for releasably locking the cover in a closed position when it is folded down over the neck of the container, wherein said outer skirt and said peripheral wall are made of a material that is resiliently flexible and can be deformed when external pressure is applied onto the external surface of said outer skirt, wherein said snap means is located on the cap in an opposite position with respect to the hinge of the cover; and wherein the one part of the snap means that is integral to the upper portion of the outer skirt extends above the peripheral wall and projects towards the hinge in such a manner as to engage the other part of the snap means when the cover is in the closed position, whereby when the external pressure is applied onto the external surface of the outer skirt underneath said snap means, said outer skirt is deformed both laterally and vertically and causes the open part of the snap means to swivel outwardly, to disengage from the other part of the snap means and thus to release the cover while simultaneously pushing said cover up to open and pivot about the hinge.

* * * * *